US006367096B1

(12) United States Patent
Quintana

(10) Patent No.: US 6,367,096 B1
(45) Date of Patent: Apr. 9, 2002

(54) TOILET LEAK DETECTOR AND OVERFLOW CONTROL

(75) Inventor: Richard Quintana, Westminster, CA (US)

(73) Assignee: Niccole Family Trust, Huntington Beach, CA (US)

( * ) Notice: Subject to any disclaimer, the term of this patent is extended or adjusted under 35 U.S.C. 154(b) by 0 days.

(21) Appl. No.: 09/769,855

(22) Filed: Jan. 25, 2001

(51) Int. Cl.[7] ..... E03D 11/02
(52) U.S. Cl. ..... 4/427
(58) Field of Search ..... 4/353, 415, 427

(56) References Cited

U.S. PATENT DOCUMENTS

| | | | | |
|---|---|---|---|---|
| 3,928,874 A | * 12/1975 | Albertson | ..... | 4/427 X |
| 5,940,899 A | 8/1999 | Makin et al. | ..... | 4/427 |
| 6,058,519 A | 5/2000 | Quintana | ..... | 4/427 |

* cited by examiner

*Primary Examiner*—Robert M. Fetsuga
(74) *Attorney, Agent, or Firm*—James G. O'Neill

(57) ABSTRACT

A microprocessor-operated flow control device for a toilet to prevent flooding upon obstructing of a waste outlet of a toilet bowl also includes a leak detector for measuring any water leakage from a toilet tank. The device includes a water level sensor assembly mounted on a clip held over a rim of the toilet bowl so as to hold the water level sensor assembly in a predetermined position within the toilet bowl, and a leak detecting element held in the interior of the toilet tank. If water bridges contacts on the water level sensor assembly, an electrical circuit or an RF connection is completed to the microprocessor in a housing, and an electric motor is actuated to drive a gear train to close a normally opened valve and shut off water to the water tank of the toilet. If a water leak is detected, an electrical or an RF signal is sent to the microprocessor to shut off water flow to the water tank. The present invention is an easily-added-on, simplified device for use with a toilet to prevent flooding and wasting water through leakage.

20 Claims, 4 Drawing Sheets

TOILET LEAK DETECTOR AND OVERFLOW CONTROL

BACKGROUND OF THE INVENTION

1. Field of the Invention

This invention relates generally to fluid control devices, and more particularly, to a device adapted to be mounted on a conventional toilet for controlling overflow of water, if the waste outlet thereof is obstructed, and for detecting any leaks in the toilet.

2. Description of Related Art

As homeowners and those who work in and around certain types of institutions, such as retirement homes, convalescent homes, and the like, are aware, toilet bowls may become blocked for any number of reasons, and a person who repeatedly flushes such a toilet will cause it to flood. This flooding may cause serious problems, particularly in institutions, such as homes for the aged, since older people may slip and fall, or be subjected to diseases by such flooding waters. Furthermore, with water conservation becoming increasingly more important, the detecting and prevention of water leaks in toilets has become a priority.

Many patents have disclosed mechanical and electrically controlled water overflow devices to prevent the overflowing of toilets. An example of such patents includes U.S. Pat. No. 6,058,509 in the name of Richard Quintana, the inventor named herein. Additionally, U.S. Pat. No. 5,940,899 to Mankin et al. discloses a system that detects the rise of water in a toilet bowl by a sensor mounted to the toilet bowl at a location above a normal water level. The sensor is operative to sense the water level above normal and generates a warning signal, as well as to close a valve by a drive assembly coupled to a processor to prevent further water delivery to the toilet system. The patent to Mankin et al. is complicated and expensive, and fails to disclose or teach a clip-on device that fits over a rim of a toilet bowl and a leak detector, as specifically disclosed herein.

The present invention further incorporates an adjustable clip that easily and conveniently positions a water detector, together with a warning-sounding alarm speaker or LED, and a low-voltage, rechargeable battery for energizing a drive assembly, as specifically disclosed in the operating system of the present invention.

The present invention provides a simple and easy-to-use device that is easily attached to a toilet to prevent overflow, and which detects water leaks in a more expeditious and cheaper manner.

SUMMARY OF THE INVENTION

Accordingly, it is a general object of the present invention to provide an improved and simplified overflow control and leak detector device. It is a particular object of the present invention to provide an improved and simplified overflow control and leak detector device in which the overflow control includes a clip that is held on a rim of a toilet bowl. It is yet another particular object of the present invention to provide an improved and simplified overflow control and leak detector system, having separate detecting portions, including a clip for a toilet bowl rim and a leak detector for mounting in a toilet tank. It is yet another particular object of the present invention to provide an improved and simplified microprocessor overflow control and leak detector device having sensing members attached to a clamping means held on a toilet bowl rim, or held in a toilet tank. And, it is still another particular object of the present invention to provide an improved and simplified overflow control and water leak detector device having a microprocessor-operated drive assembly connected to a valve means that is operated by a detector switch held in a toilet bowl, and which includes a leak detector and a warning sounding alarm speaker and one or more LED devices indicating that there is a possible overflow or a water leak in the toilet.

These and other objects and advantages of the present invention are achieved by providing a device having an overflow detecting means mounted to a clip, which clip is removably secured to a rim of a toilet bowl and connected, either electrically or by radio frequency ("RF") to means for activating a gear-operated valve held in a housing for controlling water flow to the toilet, and a leak detector sensor held in a toilet tank and connected, either electrically or by RF, to a housing holding the gear-operated valve.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings, wherein:

DESCRIPTION OF THE PREFERRED EMBODIMENTS

Figure 1:
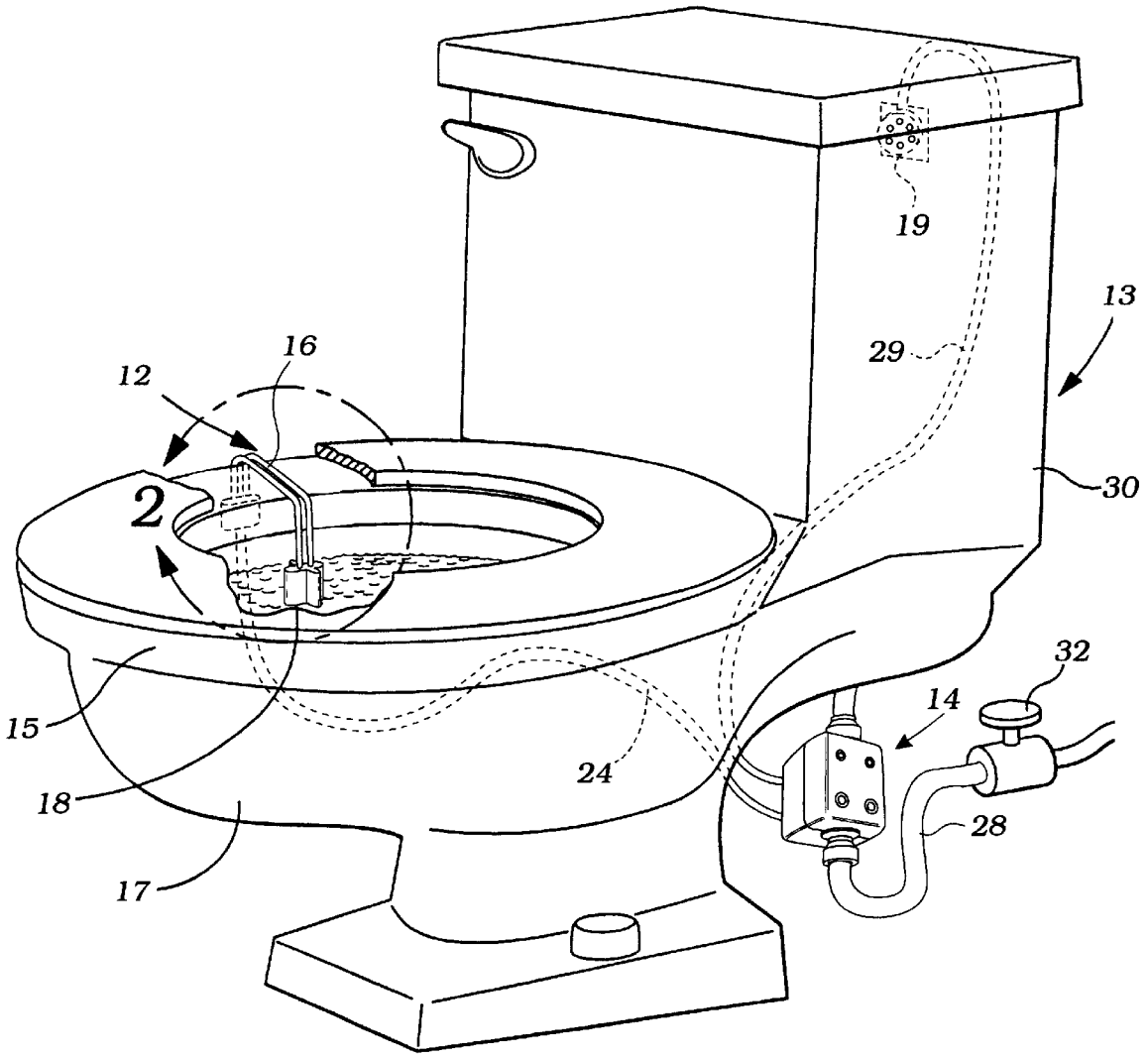
FIG. 1 is a perspective view of a conventional toilet having a seat partially broken away showing a clip-on water level detecting device mounted on a rim and connected electrically or by RF to a housing for activating a gear-operated valve means held in the housing to control water flow; together with a leak detector sensor mounted in a toilet tank and connected electrically or by RF to the housing.

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to provide for an improved and simplified overflow control and leak detecting system 10 comprised of a water level detector or sensor 12, a water leak sensor 19, such as a microphone, and a gear-actuated valve system 21, connected electrically or by RF to and held in a housing 14. The water level detector or sensor 12 is mounted on a rim 15 of a bowl 17 of a conventional or low-water-use toilet 13, as by means of an adjustable, flexible clip-on assembly 16 supporting a water detector or sensor element 18, having a normally open-switch element therein. The detector or sensor element 18 may take the form of the detector described in U.S. Pat. No. 6,058,519 to Quintana, the disclosure of which is incorporated herein in its entirety by this reference thereto. As stated, the detector element 18, includes a normally open switch, which is closed when the water level in the toilet bowl 17 reaches a predetermined level, whereupon a circuit is completed through a lead or an RF device 24 connection to a microprocessor 31 held in housing 14. A motor 26 is actuated to close a normally open valve 20 by means of a gear drive system 21, held in housing 14. Upon closing of valve 20, water flow from a water supply pipe 28 to a water tank 30 at the back of the toilet 13 will be shut off. The water supply pipe 28 has a cut-off valve 32, of a type well known to those skilled in the art, before the housing 14, so that water pressure can be manually shut-off, as needed.

When water reaches the sensor 18, it causes the microprocessor 31 to operate the ball valve 20 to the closed position. When the valve 20 moves to the closed position, the overflow LED light and/or an RF-operated battery-operated remote light for the hearing impaired will be turned on.

The leak detector sensor or microphone 19 is held within the water tank 30, preferably at the rear or on the top thereof, by a mounting or securing means, such as a clip, two-sided tape, a hook and loop securing means, a suction cup, or the like, secured to or holding the microphone 19, as by means of an opening, or the like. The microphone 19 is connected electrically or by an RF device 29 to the microprocessor 31 held in housing 14.

Figure 2:
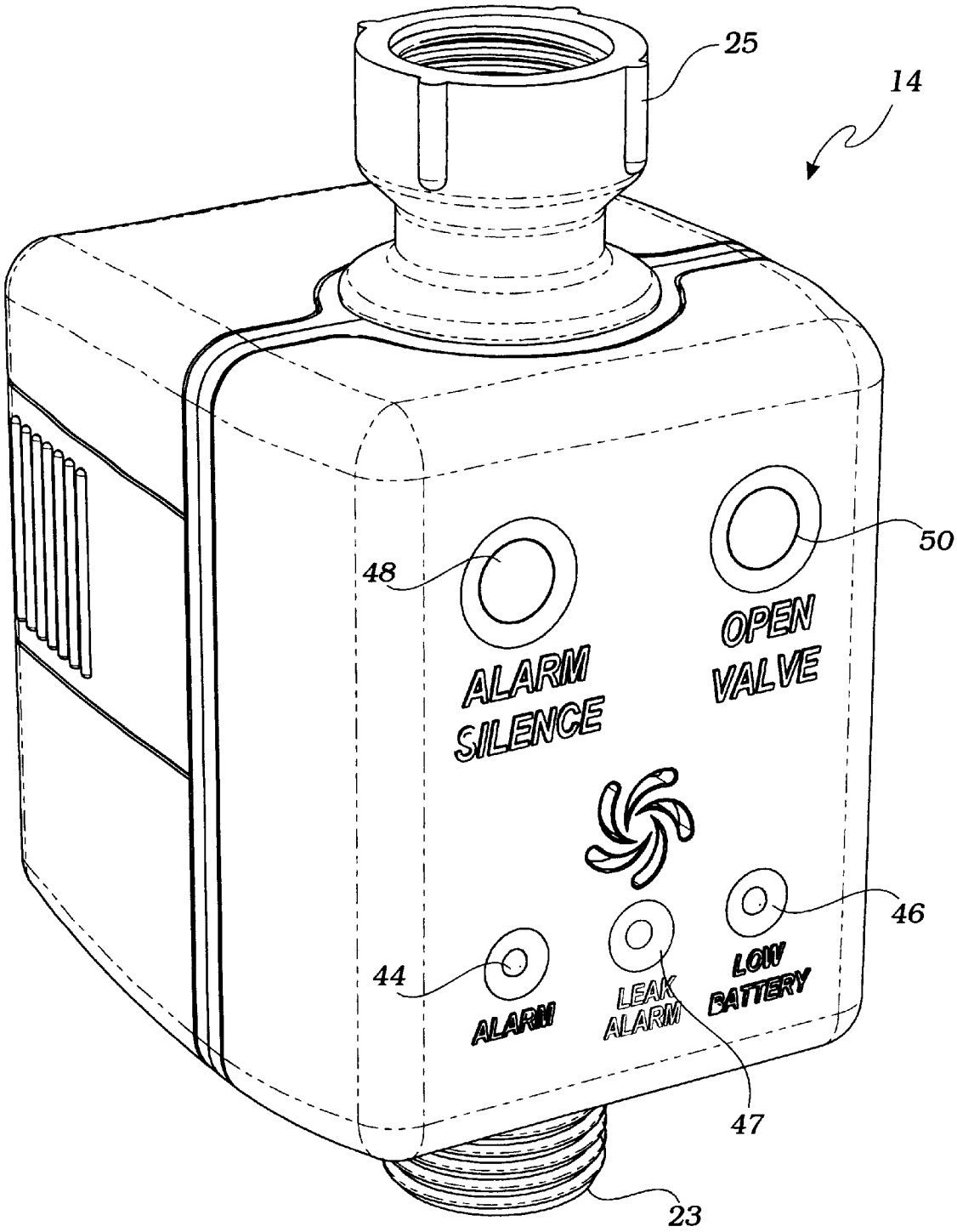
FIG. 2 is an enlarged front perspective view of the housing of the present invention.
Figure 3:
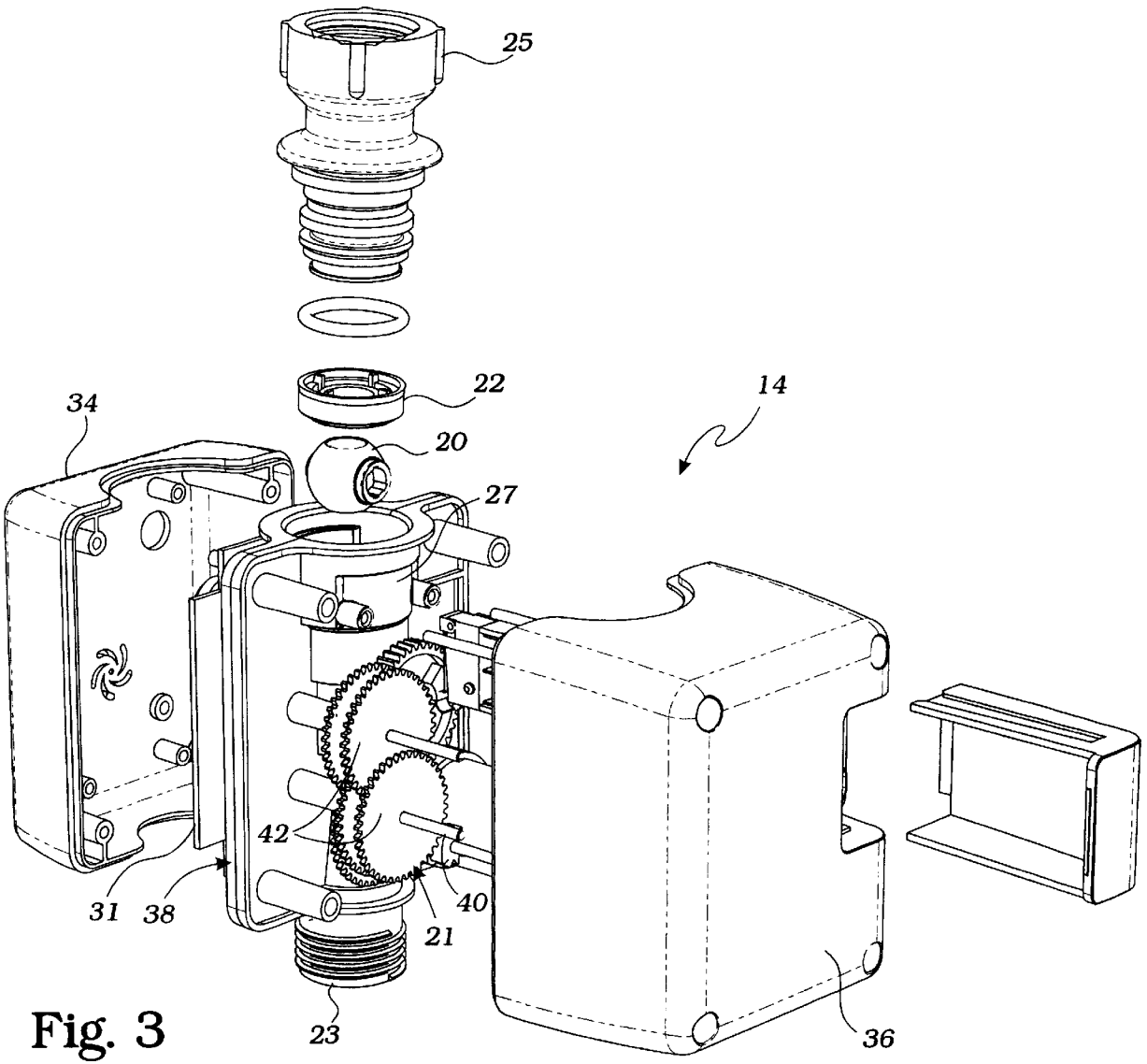
FIG. 3 is an exploded perspective view of the housing of FIG. 2.
Figure 4:
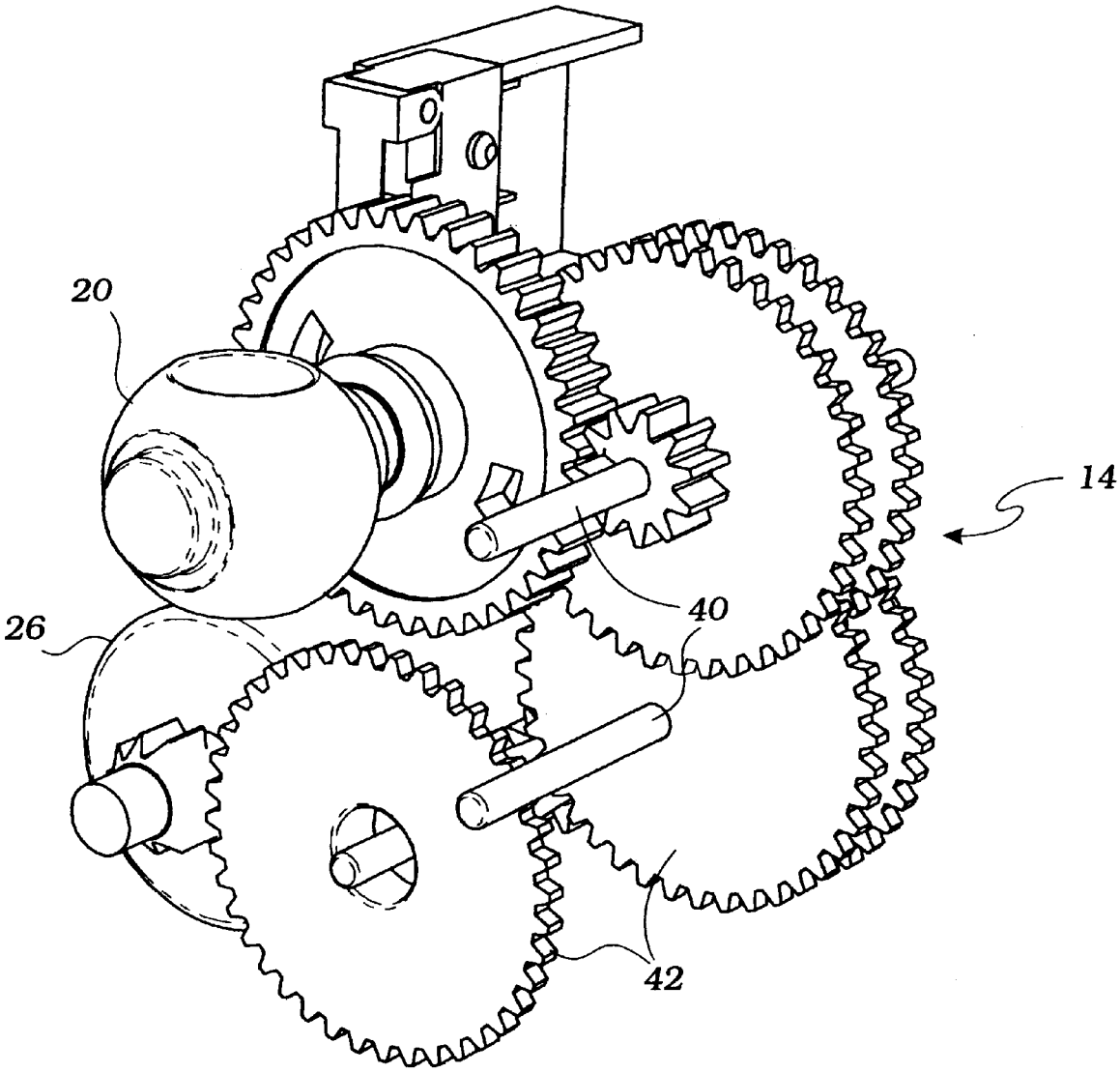
FIG. 4 is a partial perspective view of a preferred embodiment of the gearing and a motor to operate a ball valve.

As best shown in FIGS. 2–4, the housing 14 is preferably rectangular, having a front cover or face 34, a rear cover or face 36, an inlet 23 and an outlet 25 for connection into the waterline 28 and/or to the bottom of the toilet tank 30. The normally open valve 20 is preferably of the rotary type and supported in a valve seat 22, held in a conduit 27 formed in the housing 14, between inlet 23 and outlet 25. The motor 26 is connected between the microprocessor 31 and a power source, such as a battery or an electrical outlet, to operate the valve 20 between the open and closed positions via the gear drive system 21, which is rotatably held in the housing 14 between the front and back covers 34, 36. The housing 14 includes an internal frame means 38 that contains a PC board holding the microprocessor and various other electronic components, the conduit 27 and a plurality of mounting pins or shafts 40, for rotatably carrying a plurality of different size gears 42.

The housing 14 may include a warning sound alarm speaker 44, or the like, connected to the microprocessor, to sound an alarm that indicates the valve 20 has been closed because too much water is in the toilet bowl, or that the toilet is leaking water. The housing also preferably includes a number of alarms, LED lights or indicators 44, 46, 47 connected to the microprocessor 31, which will flash or provide a continuous alarm or light to indicate that there is an overflow condition and/or a leak, and/or that a battery or power source is low. The housing may also contain switches 48 and 50, connected in the microprocessor, to allow the alarm to be shut off and to manually open the valve 20, after it has been closed, provided that no water is sensed by the sensor 18. That is, water will not be allowed to flow back to the tank unless the overflow condition has been cleared, and the water level has receded.

The microprocessor 31 includes an adjustable timer or clock for operation of the microphone 19. For example, every 60 minutes or so, power is applied to the microphone 19 for an adjustable period of say 3–5 seconds. If the microphone does not pick up any sound, the microprocessor will wait for a further 60 minutes to monitor again.

If the microphone 19 picks up a sound detecting a leak, it will repeat another 3–5 second test, to assure that a positive leak alarm has been picked up. At this point, the microprocessor 31 will continue the monitoring for up to as much as 3 to 5 minutes to ensure that a real leak, and not a standard flush, is present. This time limit can be changed, if necessary. If any silence should occur for a specified time set by the microprocessor during this 3 to 5 minutes, the microprocessor will start a new 60-minute monitoring process again. However, if the sound continues during the 3 to 5 minute test limit, the microprocessor 31 will close the valve 20 and the leak alarm will go on.

The leak alarm LED light, located at the front of the unit, will also be turned on. The user can turn off the alarm if desired and repair the leak at this time. The user can, at any time, press the open valve button to open the water valve 20 to allow water back to the tank.

When the valve 20 is returned to its original open position, the 60-minute leak detecting monitoring will start again. The microprocessor 31 can be programmed to monitor for any time interval time desired.

Those skilled in the art will appreciate that various adaptations and modifications of the just-described preferred embodiments can be configured without departing from the scope and spirit of the invention. Therefore, it is to be understood that, within the scope of the appended claims, the invention may be practiced other than as specifically described herein.

What is claimed is:

1. A combination overflow control and leak detecting device for a toilet, comprising:

a flexible, clip-on assembly adapted to be secured to a rim of a toilet bowl;

a detector element secured at one end of the flexible, clip-on assembly for insertion into a toilet bowl;

means for connecting the detector element to a motor-actuated, normally opened valve held in a housing adapted to be connected to a waterline connected to a water tank of a toilet to which the overflow control device is attached; and a leak sensor adapted to be connected to a water tank of a toilet to which the overflow control device is attached; the leak sensor having a connection to the housing.

2. The overflow control device of claim 1 wherein the sensor element is adjustably held on the flexible clip-on assembly and the leak sensor includes means for mounting it in the interior of a toilet tank.

3. The overflow control device of claim 2, further including a warning-sounding speaker, and a plurality of actuating switches in the housing.

4. The overflow control device of claim 3 wherein a first of the plurality of actuating switches is to open the valve in the housing.

5. The overflow device of claim 4 wherein a second of the plurality of actuating switches is to shut off the warning sounding speaker.

6. The overflow control device of claim 5, further including a plurality of light indicators in the housing.

7. The overflow control device of claim 1 wherein the motor-actuated normally opened valve has a gear drive mounted between an electrical motor and a rotary valve element in the housing.

8. A combination overflow control and water leak detecting device and a toilet, comprising:

the toilet including a toilet bowl having a rim, a water tank and a water line connected to the water tank;

a flexible, clip-on assembly having a sensor assembly held at one end, releasably secured to the rim, with the sensor assembly held in the toilet, above a top surface of any water held therein;

a microprocessor motor-operated, normally opened valve, including a gear drive and an electrical power source held in a housing, connected in the waterline to control the flow of water to the water tank;

means for connecting the sensor assembly to the microprocessor; and the water leak detecting device including a leak sensor for detecting the leaking of water from the water tank; and further means for connecting the sensor to the microprocessor.

9. The combination overflow control and water leak detecting device of claim 8 wherein the sensor assembly is adjustably held on the flexible clip-on assembly and wherein the leak sensor is held to means for mounting in the interior of a toilet tank.

10. The combination overflow control and water leak detecting device of claim 9, further including a warning-sounding speaker, and a plurality of actuating switches in the housing, and wherein the means for connecting the sensor assembly and the further means for connecting the leak sensor are electrical or RF.

11. The combination overflow control and water leak detecting device of claim 10 wherein a first of the plurality of actuating switches is to open the valve in the housing.

12. The combination overflow control and water leak detecting device of claim 11 wherein a second of the plurality of actuating switches is to shut off the warning sounding speaker.

13. The combination overflow control and water leak detecting device of claim 12, further including a plurality of light indicators in the housing.

14. The combination overflow control and water leak detecting device of claim 13 wherein the motor-actuated normally opened valve has a gear drive mounted between an electrical motor and a rotary valve element.

15. A combination overflow control and leak detecting device for a toilet, comprising:

a flexible, clip-on assembly having a rim attachment end and a sensor holding end;

a sensor assembly adjustably held in the sensor holding end and having an electrical or RF connection to a housing;

the rim attachment end adapted to be attached to the rim of a toilet bowl with the sensor assembly held within the toilet bowl and above a surface of any water held therein;

the housing having a gear driven motor-actuated, normally opened valve, connected between a microprocessor and a power source and a low battery indicator, adapted to be held in a waterline to a toilet to control the flow of water to a water tank in the toilet; and a water leak detector adapted to be held in a toilet tank electrically or by RF connection to the microprocessor.

16. The combination overflow control and leak detecting device of claim 15 wherein the water leak detector comprises a microphone.

17. The combination overflow control and leak detecting device of claim 16, further including a warning-sounding speaker, and a pair of actuating switches in the housing.

18. The combination overflow control and leak detecting device of claim 16 wherein a first of the pair of actuating switches is to open the valve in the housing; and a second of the pair of actuating switches is to shut off the warning sounding speaker.

19. The combination overflow control and leak detecting device of claim 16, further including a "low battery" LED and a leak alarm LED in the housing.

20. The combination overflow control and leak detecting device of claim 16 wherein the motor-actuated normally opened valve has a gear drive mounted between an electrical motor and a rotary valve element.

* * * * *